US009137868B2

(12) United States Patent
Xu et al.

(10) Patent No.: US 9,137,868 B2
(45) Date of Patent: Sep. 15, 2015

(54) LIGHT EMITTING ELEMENT DRIVING CIRCUIT

(75) Inventors: Feng Xu, Kiryu (JP); Shuhei Kawai, Ota (JP); Tomoyuki Goto, Ota (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 227 days.

(21) Appl. No.: 13/495,618

(22) Filed: Jun. 13, 2012

(65) Prior Publication Data

US 2013/0002161 A1 Jan. 3, 2013

(30) Foreign Application Priority Data

Jun. 13, 2011 (JP) ..... 2011-131441

(51) Int. Cl.
*H05B 37/00* (2006.01)
*H05B 33/08* (2006.01)

(52) U.S. Cl.
CPC ..... *H05B 33/0824* (2013.01); *H05B 33/0851* (2013.01)

(58) Field of Classification Search
USPC ..... 315/200 R
See application file for complete search history.

(56) References Cited

U.S. PATENT DOCUMENTS

2002/0149415 A1* 10/2002 Bienvenu et al. ..... 327/442
2003/0057864 A1* 3/2003 Smith ..... 315/209 R
2010/0090618 A1* 4/2010 Veltman ..... 315/307
2010/0148681 A1* 6/2010 Kuo et al. ..... 315/193
2010/0207536 A1* 8/2010 Burdalski et al. ..... 315/224
2011/0109245 A1* 5/2011 Lin et al. ..... 315/294
2011/0109249 A1* 5/2011 Liu et al. ..... 315/307
2011/0193488 A1* 8/2011 Kanamori et al. ..... 315/209 R

FOREIGN PATENT DOCUMENTS

JP 2010050336 A 3/2010

* cited by examiner

*Primary Examiner* — Douglas W Owens
*Assistant Examiner* — Jonathan Cooper
(74) *Attorney, Agent, or Firm* — Rennie William Dover

(57) ABSTRACT

In accordance with an embodiment, a light emitting element driving circuit includes a comparator having an input connected to smoothing circuit and an output connected to a voltage-dividing circuit through a transistor. A drain-to-source resistance of the transistor is connected in parallel with a portion of the voltage dividing circuit. An output signal of the voltage dividing circuit is connected to another comparator that generates a drive transistor drive signal. The drive transistor is connected to one or more light emitting elements. In accordance with another embodiment, a reference voltage is generated in response to a rectified signal and compared with a sense voltage to generate a drive signal that is used to drive the drive transistor. Light is emitted from the one or more light emitting elements in response to the drive signal and the rectified voltage being greater than the forward voltage drops of the one or more light emitting elements.

18 Claims, 11 Drawing Sheets

-PRIOR ART-

LIGHT EMITTING ELEMENT DRIVING CIRCUIT

CROSS-REFERENCE TO RELATED APPLICATION

This application claims the benefit of priority to Japanese Patent Application No. 2011-131441, filed Jun. 13, 2011, of which full contents are incorporated herein by reference.

BACKGROUND OF THE INVENTION

1. Field of the Invention

The present invention relates to a light emitting element driving circuit.

2. Description of the Related Art

Lighting equipment using an LED (Light Emitting Diode) may use an LED driving circuit which drives an LED while improving the power factor (See Patent Document 1, for example).

FIG. 11 is a diagram illustrating a common configuration of an LED driving circuit. When an AC voltage Vac of a commercial power supply is supplied to a full-wave rectifying circuit 300, the full-wave rectifying circuit 300 applies full-wave rectification to the AC voltage Vac for output. Resistors 310 and 320 divide the rectified voltage Vrec subjected to the full-wave rectification at the full-wave rectifying circuit 300 and outputs the result as a reference voltage Vref. The switching circuit 330 turns on the NMOS transistor 340 at predetermined intervals, and the switching circuit 330 turns off the NMOS transistor 340 when a voltage Vs according to the current flowing through an LED 350 becomes the reference voltage Vref. Since the reference voltage Vref and the rectified voltage Vrec are similar in an LED driving circuit 200, the waveform of the current flowing through the LED 350 also becomes similar to the waveform of the rectified voltage Vrec. Therefore, the LED driving circuit 200 can drive the LED 350 while improving the power factor.

The amplitude of the AC voltage Vac of the commercial power supply may greatly vary within a range of, for example, 90 to 140V. In such a case, the level of the reference voltage Vref also varies greatly resulting with cases where the current flowing through the LED 350 vary significantly, and the brightness of the LED 350 largely deviates from the desired brightness.

SUMMARY OF THE INVENTION

An light emitting element driving circuit according to an aspect of the present invention, comprises: a rectifying circuit configured to output a rectified voltage obtained by providing rectification to an AC voltage; a voltage-dividing circuit configured to output as a reference voltage, a divided voltage obtained by dividing the rectified voltage; a transistor configured to increase a driving current of a light emitting element in accordance with the rectified voltage when turned on and to reduce the driving current of the light emitting element when turned off; a control circuit configured to bring the transistor to an on state or an off state at predetermined intervals and to bring the transistor to the other of the on state or the off state when a voltage according to a current flowing through the transistor increases and becomes the reference voltage; and a voltage-dividing ratio adjustment circuit configured to set a voltage-dividing ratio of the voltage dividing circuit as a first voltage-dividing ratio to reduce the reference voltage when an amplitude of the rectified voltage is larger than a predetermined amplitude and to set the voltage-dividing ratio as a second voltage-dividing ratio to increase the reference voltage when an amplitude of the rectified voltage is smaller than the predetermined amplitude.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

At least the following matters will become apparent from the description in the present specification and the drawings attached.

Figure 1:
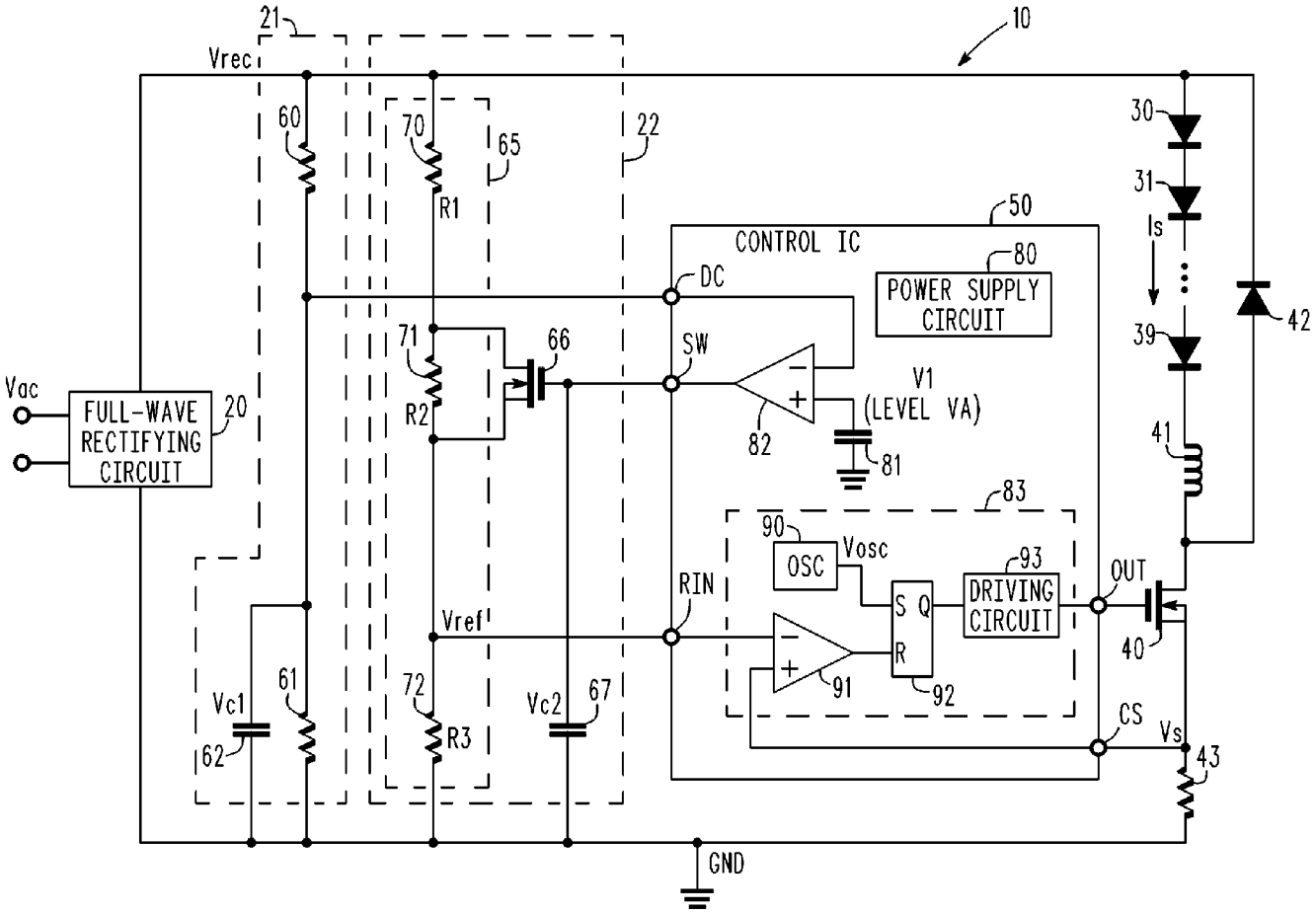
FIG. 1 is a diagram illustrating a configuration of an LED driving circuit 10 according to an embodiment of the present invention.

FIG. 1 is a diagram illustrating a configuration of the LED driving circuit 10 according to an embodiment of the present invention. The LED driving circuit 10 is, for example, a circuit which drives LEDs 30 to 39 on the basis of an AC voltage Vac of a commercial power supply whose amplitude fluctuates within the range of 90 to 140 V. The LED driving circuit 10 is configured to include a full-wave rectifying circuit 20, a smoothing circuit 21, a reference-voltage generation circuit 22, LEDs 30 to 39, an NMOS transistor 40, an inductor 41, a diode 42, a resistor 43, and a control IC (Integrated Circuit) 50.

The full-wave rectifying circuit 20 provides full-wave rectification to the inputted AC voltage Vac and outputs rectified voltage Vrec.

The smoothing circuit 21 is a circuit for generating a DC voltage according to the amplitude of the rectified voltage Vrec and is configured to include resistors 60 and 61 and a capacitor 62. The resistors 60 and 61 divide the rectified voltage Vrec, and the capacitor 62 smoothes voltage generated in the resistor 61. Thus, DC voltage Vc1 of a level according to the amplitude of the rectified voltage Vrec (AC voltage Vac) is generated at the capacitor 62.

The reference-voltage generation circuit 22 is a circuit which generates a reference voltage Vref similar to the rectified voltage Vrec and is configured to include a voltage-dividing circuit 65, an NMOS transistor 66, and a capacitor 67. The voltage-dividing circuit 65 includes resistors 70 to 72 connected in series. The rectified voltage Vrec is applied to the resistor 70 (first resistor), the resistor 71 (second resistor) is provided between the resistors 70 and 72, and the resistor 72 (third resistor) is grounded. A source electrode of the NMOS transistor 66 (switch) is connected to one end of the resistor 71, while a drain electrode is connected to the other end of the resistor 71, and the capacitor 67 is connected to a gate electrode.

Thus, the reference voltage Vref generated at the node where the resistor 71 and the resistor 72 are connected is the voltage as represented by equation (1):

$$Vref=(R3/(R1+(R2//Rm)+R3))\times Vrec \quad (1)$$

Here, resistance values of the resistors 70 to 72 are R1 to R3, respectively, and resistance between the drain and the source of the NMOS transistor 66 is Rm.

The reference voltage Vref1 when the NMOS transistor 66 is in the off state is as follows:

$$Vref1=(R3/(R1+R2+R3))\times Vrec \quad (2)$$

The resistance value Rm is designed to become sufficiently larger than the resistance value R2 when the NMOS transistor 66 is in the off state.

On the other hand, the reference voltage Vref2 is as follows when the NMOS transistor 66 is in the on state:

$$Vref2=(R3/(R1+R3))\times Vrec \quad (3)$$

The resistance value Rm is designed to become sufficiently smaller than the resistance value R2 when the NMOS transistor 66 is in the on state. Here, a voltage-dividing ratio (R3:(R1+R2+R3)) of the voltage-dividing circuit 65 is set as voltage-dividing ratio A (first voltage-dividing ratio) when the NMOS transistor 66 is in the off state, while voltage-dividing ratio (R3:(R1+R3)) of the voltage-dividing circuit 65 is set as voltage-dividing ratio B (second voltage-dividing ratio) when the NMOS transistor 66 is in the on state. Factor (R3/(R1+R2+R3)) of equation (2) is set as the value of the voltage-dividing ratio A, while factor (R3/(R1+R3)) of equation (3) is set as the value of the voltage-dividing ratio B. Therefore, the value of the voltage-dividing ratio A is smaller than the value of the voltage-dividing ratio B.

As described above, the reference-voltage generation circuit 22 outputs reference voltage Vref whose level varies in accordance with the state of the NMOS transistor 66 and is similar to the rectified voltage Vrec.

The LEDs 30 to 39 are ten white LEDs connected in series, and rectified voltage Vrec is applied to the anode of the LED 30 and one end of the inductor 41 is connected to the cathode of the LED 39. A forward voltage of each of the LEDs 30 to 39 is assumed to be 3 V, for example.

The NMOS transistor 40 controls increase/decrease of the driving current Is for driving the LEDs 30 to 39 along with the inductor 41 and the diode 42. Specifically, when the NMOS transistor 40 is turned on when the level of the rectified voltage Vrec is higher than the sum (30 V) of all the forward voltages of the LEDs 30 to 39, the driving current Is increases in accordance with the rectified voltage Vrec. Energy according to the current value of the driving current Is is accumulated in the inductor 41. On the other hand, when the NMOS transistor 40 is turned off, the energy accumulated in the inductor 41 is emitted through the loop of the LEDs 30 to 39, the inductor 41, and the diode 42, and the driving current Is drops. Even when the NMOS transistor 40 is turned on, the driving current Is does not flow when the level of the rectified voltage Vrec is lower than 30 V since all the LEDs 30 to 39 are in an off state. That is, the LEDs 30 to 39 emit light only when the level of the rectified voltage Vrec is higher than 30 V.

The resistor 43 is a resistor which detects a current value of the driving current Is when the NMOS transistor 40 is turned on and is provided between the source of the NMOS transistor 40 and the ground GND. The voltage generated at one end of the resistor 43 and of a level according to the current value of the driving current Is is set as detected voltage Vs.

The control IC 50 generates to the reference-voltage generation circuit 22 reference voltage Vref at a level according to the amplitude of the rectified voltage Vrec and controls switching of the NMOS transistor 40 on the basis of reference voltage Vref and detected voltage Vs. The control IC 50 is configured to include a power supply circuit 80, a reference voltage circuit 81, a comparator 82, and a switching control circuit 83.

The power supply circuit 80, for example, generates power supply for operating each block in the control IC 50 when rectified voltage Vrec is inputted through the terminal not shown.

The reference voltage circuit 81 and the comparator 82 are charging/discharging circuits which charge/discharge the capacitor 67 in accordance with the level of voltage Vc1 applied to the terminal DC, that is, amplitude of the rectified voltage Vrec.

The reference voltage circuit 81 (voltage generation circuit) generates voltage V1 of a predetermined level VA. The predetermined level VA (first level) is a level equal to the level of the voltage Vc1 obtained in the smoothing circuit 21 when the rectified voltage Vrec with a predetermined amplitude Vp is inputted to the smoothing circuit 21.

Voltage Vc1 is applied to an inverting input terminal of the comparator 82 through terminal DC, and voltage V1 of the predetermined level VA is applied to a non-inverting input terminal. Thus, the comparator 82 charges the capacitor 67 through terminal SW when the level of the voltage Vc1 is lower than the predetermined level VA, whereas the comparator 82 discharges the capacitor 67 when the level of the voltage Vc1 is higher than the predetermined level VA.

Figure 2:
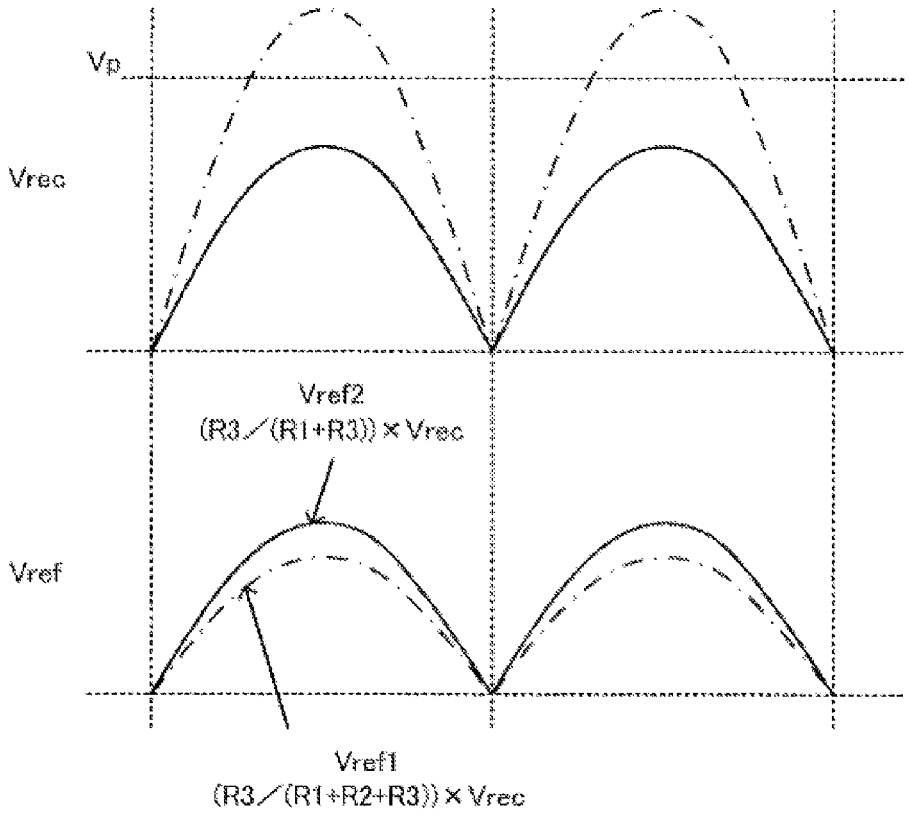
FIG. 2 is a diagram illustrating an example of waveforms of reference voltages Vref1 and Vref2.

For example, the level of voltage Vc1 does not exceed the predetermined level VA when the rectified voltage Vrec smaller than predetermined amplitude Vp is continuously smoothed at the smoothing circuit 21. In such a case, the capacitor 67 is continuously charged so that the level of the charging voltage Vc2 of the capacitor 67 becomes higher than a predetermined level VB (second level) at which the NMOS transistor 66 is turned on. As a result, for example, reference voltage Vref2 obtained by dividing the value of the rectified voltage Vrec with a larger voltage-dividing ratio B is outputted as the reference voltage Vref, as indicated by a solid line in FIG. 2.

On the other hand, for example, the level of voltage Vc1 becomes higher than the predetermined level VA when the rectified voltage Vrec larger than the predetermined amplitude Vp is continuously smoothed at the smoothing circuit 21. In such a case, the NMOS transistor 66 is turned off since the capacitor 67 is discharged. As a result, for example, reference voltage Vref1 obtained by dividing the rectified voltage Vrec with a smaller voltage-dividing ratio A is outputted as the reference voltage Vref, as indicated by a one-dot-chain line in FIG. 2.

As described above, the control IC 50 adjusts the voltage-dividing ratio of the voltage dividing circuit 65 so that the reference voltage Vref drops when the AC voltage Vac with large amplitude is continuously inputted, while the reference voltage Vref increases when the AC voltage Vac with small amplitude is continuously inputted. Therefore, the level of the reference voltage Vref is suppressed from varying largely even when the amplitude of the AC voltage Vac largely fluctuates in the LED driving circuit 10.

The reference voltage circuit 81, the comparator 82, the NMOS transistor 66, and the capacitor 67 correspond to a voltage dividing ratio adjustment circuit which adjusts the voltage-dividing ratio of the voltage dividing circuit 65.

The switching control circuit 83 (control circuit) is a circuit which controls switching of the NMOS transistor 40 so that the waveform of the driving current Is becomes similar to the waveform of the reference voltage Vref and is configured to include an oscillation circuit 90, a comparator 91, an SR flip-flop 92, and a driving circuit 93.

The oscillation circuit (OSC) 90 outputs an oscillation signal Vosc with a predetermined cycle, and the comparator 91 compares the reference voltage Vref inputted through terminal RIN with the detected voltage Vs inputted through terminal CS. The cycle of the oscillation signal Vosc is assumed to be approximately 100 kHz, for example, and to be sufficiently shorter than the cycle of the AC voltage Vac (50 Hz, for example).

Figure 3:
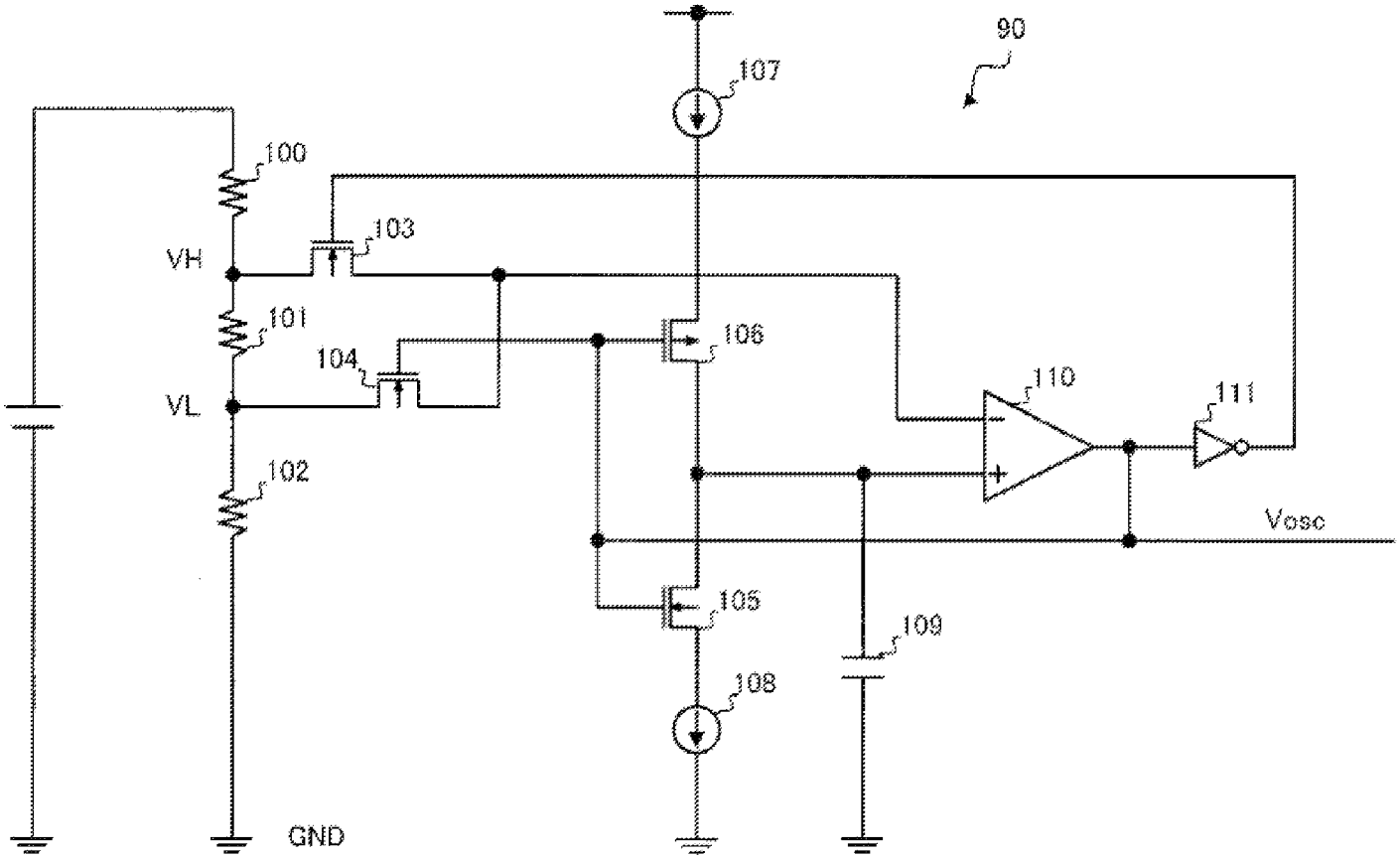
FIG. 3 is a diagram illustrating a configuration of an oscillation circuit 90.

Moreover, the oscillation circuit 90 is configured to include, for example, resistors 100 to 102, NMOS transistors 103 to 105, a PMOS transistor 106, bias current sources 107 and 108, a capacitor 109, a comparator 110, and an inverter 111 as illustrated in FIG. 3.

When the NMOS transistors 103 and 104 are turned on, they apply voltages VH and VL (<VH) to the inverting input terminals of the comparator 110. The NMOS transistor 105, the PMOS transistor 106, and the bias current sources 107 and 108 charge/discharge the capacitor 109 on the basis of an output of the comparator 110.

First, when the oscillation signal Vosc being an output of the comparator 110 becomes high level (hereinafter referred to as H level), the NMOS transistor 104 is turned on, while the NMOS transistor 103 is turned off. Thus, voltage VL is applied to the inverting input terminal of the comparator 110. Moreover, since the NMOS transistor 105 is turned on, the capacitor 109 is discharged by a current generated by the bias current source 108. Then, when the charging voltage of the capacitor 109 (voltage of a non-inverting input terminal of the comparator 110) becomes lower than the voltage VL, the comparator 110 changes the oscillation signal Vosc to a low level (hereinafter referred to as L level).

Subsequently, when the oscillation signal Vosc becomes L level, the NMOS transistor 104 is turned off, and the NMOS transistor 103 turned on. Thus, the voltage VH is applied to the inverting input terminal of the comparator 110. Moreover, since the PMOS transistor 106 is turned on, the capacitor 109 is charged by a current generated by the bias current source 107. When the charging voltage of the capacitor 109 (voltage of the non-inverting input terminal of the comparator 110) becomes higher than voltage VH, the comparator 110 changes the oscillation signal Vosc to H level. By repeating such operations, the oscillation circuit 90 outputs the oscillation signal Vosc (clock signal) with a predetermined cycle.

The oscillation signal Vosc is inputted to the S input of the SR flip-flop 92, and the comparison result of the comparator 91 is inputted to the R input. Thus, the Q output of the SR flip-flop 92 becomes H level at predetermined intervals when the oscillation signal Vosc becomes H level and the Q output becomes L level when the detected voltage Vs increases and becomes the reference voltage Vref.

The driving circuit 93 turns on the NMOS transistor 40 through a terminal OUT when the Q output of the SR flip-flow 92 becomes H level and turns off the NMOS transistor 40 when the Q output of the SR flip-flop 92 becomes L level. Therefore, the driving circuit 93 turns on the NMOS transistor 40 at predetermined intervals and turns off the NMOS transistor 40 when the detected voltage Vs according to a peak current of the driving current Is becomes the reference voltage Vref. As a result, the waveform of the driving current Is becomes similar to the waveform of the reference voltage Vref.

<<Operation of LED Driving Circuit 10 (Amplitude of Rectified Voltage Vrec>Predetermined Amplitude Vp)>>

Figure 4:
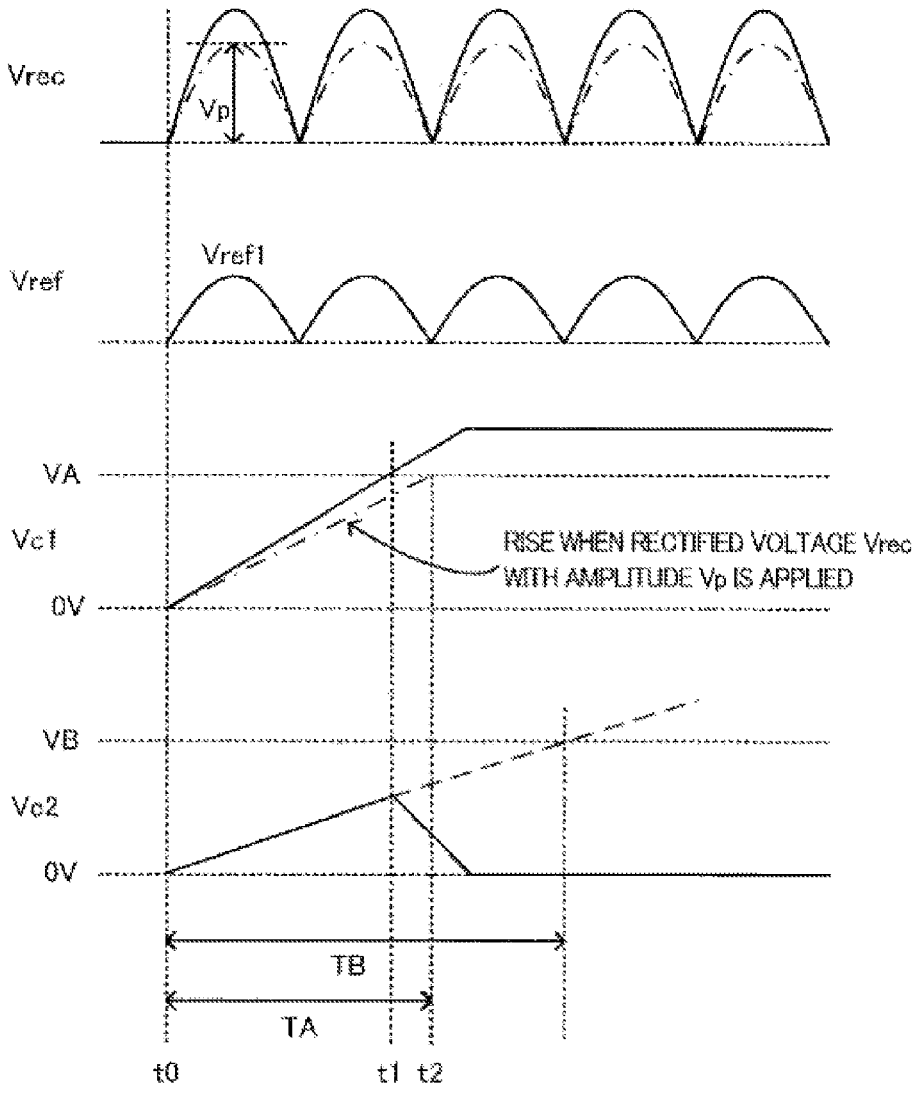
FIG. 4 is a diagram for explaining an operation of the LED driving circuit 10 when the amplitude of an AC voltage Vac is large.

Here, with reference to FIG. 4, description will be given of an operation at the start of the LED driving circuit 10 when AC voltage Vac with large amplitude is inputted, that is, when rectified voltage Vrec with an amplitude larger than the predetermined amplitude Vp is generated. The capacitors 62 and 67 are assumed to be discharged and the voltage Vc1 and the charging voltage Vc2 are both assumed to be 0 V before the LED driving circuit 10 is started. Here, the time period since a rectified voltage Vrec with a predetermined amplitude Vp is applied to the smoothing circuit 21 until the level of voltage Vc1 of the discharged capacitor 62 becomes the predetermined level VA is set as period TA, and that until the level of charging voltage Vc2 of the discharged capacitor 67 becomes the predetermined level VB is set as period TB. It is also assumed that a current value of a source current of the comparator 82, for example, is designed so that period TB (second period) is longer than period TA (first period) in the present embodiment. In FIG. 4, the waveform of the rectified voltage Vrec with a predetermined amplitude Vp and a rising waveform of the voltage Vc1 when the rectified voltage Vrec with a predetermined amplitude Vp is applied are illustrated for the sake of convenience.

First, when the AC voltage Vac is inputted at time t0, rectified voltage Vrec according to AC voltage Vac is generated raising the voltage Vc1 from 0 V. Here, since the level of voltage Vc1 is lower than the predetermined level VA of voltage V1, the capacitor 67 is charged by the comparator 82, and the charging voltage Vc2 is also raised from 0 V. During this period, the NMOS transistor 66 is in the off state since the level of the charging voltage Vc2 is lower than the predetermined level VB. Therefore, reference voltage Vref1 is outputted as the reference voltage Vref.

The rectified voltage Vrec with amplitude larger than the predetermined amplitude Vp is applied to the smoothing circuit 21 at time t0. Thus, the voltage Vc1 increases slightly faster than a case in which the rectified voltage Vrec with predetermined amplitude Vp is applied to the smoothing circuit 21 (waveform indicated by alternate long and short dashed line in FIG. 4). Therefore, the level of voltage Vc1 becomes the predetermined level VA at time t1 earlier than time t2 after period TA has elapsed since time t0.

The capacitor 67 is discharged at time t1, and thus charging voltage Vc2 drops at time t1 and thereafter. As described above, the level of charging voltage Vc2 never exceeds the predetermined level VB when AC voltage Vac with large amplitude is inputted. Therefore, the reference voltage Vref1 is constantly outputted as the reference voltage Vref.

<<Operation of LED Driving Circuit 10 (Amplitude of Rectified Voltage Vrec<Predetermined Amplitude Vp)>>

Figure 5:
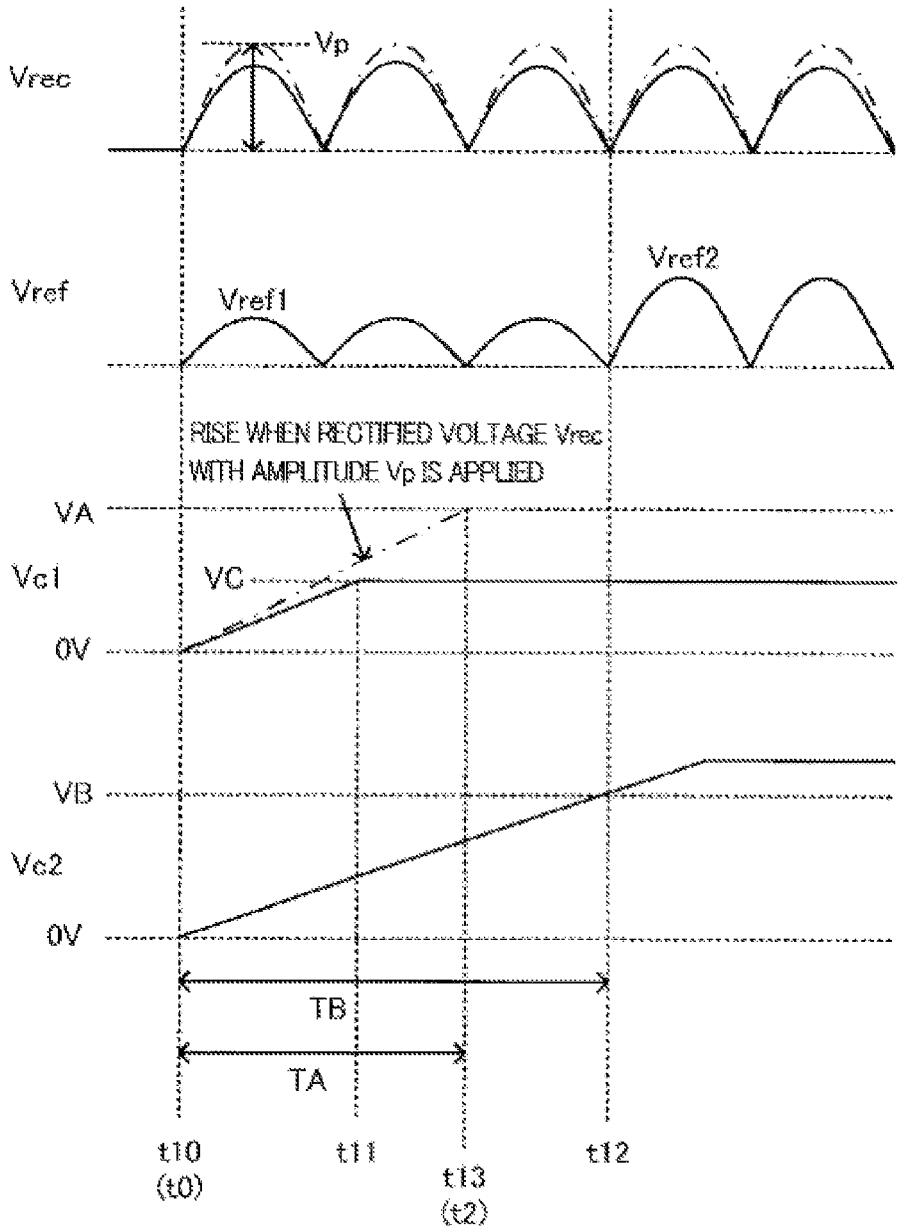
FIG. 5 is a diagram for explaining the operation of the LED driving circuit 10 when the amplitude of the AC voltage Vac is small.

Description will follow of an operation for starting the LED driving circuit 10 when AC voltage Vac with a small amplitude is inputted, that is, when rectified voltage Vrec with an amplitude smaller than the predetermined amplitude Vp is generated with reference to FIG. 5. Similar to FIG. 4, FIG. 5 also illustrates the waveform of the rectified voltage Vrec with predetermined amplitude Vp, and the rising waveform of voltage Vc1 when the rectified voltage Vrec with predetermined amplitude Vp is applied for the sake of convenience.

First, when the AC voltage Vac is inputted at time t10, rectified voltage Vrec according to AC voltage Vac is generated raising the voltage Vc1 from 0 V. Moreover, since the level of voltage Vc1 is lower than the predetermined level VA of voltage V1, the charging voltage Vc2 is also raised from 0 V. During this period, since the level of charging voltage Vc2 is lower than predetermined level VB, reference voltage Vref1 is outputted as the reference voltage Vref.

Subsequently, the voltage Vc1 stops rising at time t11 when the level of the voltage Vc1 becomes level Vc obtained when the inputted rectified voltage Vrec was smoothed. At time t11 and thereafter, the capacitor 67 is continuously charged since the level of voltage Vc1 is lower than the level of voltage VA. Therefore, the level of charging voltage Vc2 gradually increases.

At time t12 after time period TB has elapsed since time t10, the level of charging voltage Vc2 becomes the predetermined level VB. As a result, the NMOS transistor 66 is turned on to output reference voltage Vref2 as the reference voltage Vref. Time t13 in FIG. 5 is the time after period TA has elapsed since time t10. Thus, time t10 and time t13 in FIG. 5 correspond to time t0 and time t2 in FIG. 4, respectively.

As described above, when AC voltage Vac with small amplitude is inputted, the voltage-dividing ratio of the voltage dividing circuit 65 is adjusted so that the reference voltage Vref becomes high accordingly. On the other hand, as described with reference to FIG. 4, the voltage-dividing ratio of the voltage-dividing circuit 65 is adjusted so that the rise of the reference voltage Vref is suppressed when AC voltage Vac with large amplitude is inputted. Therefore, in the LED driving circuit 10, the level of the reference voltage Vref can be suppressed from varying largely even when the amplitude of AC voltage Vac largely fluctuates. As a result, the LED driving circuit 10 can keep substantially constant the current value of the driving current Is of the LEDs 30 to 39 regardless of the amplitude of the AC voltage Vac. That is, the LED driving circuit 10 can make the LEDs 30 to 39 emit light at desired brightnesses.

Another Embodiment of the Control IC

Figure 6:
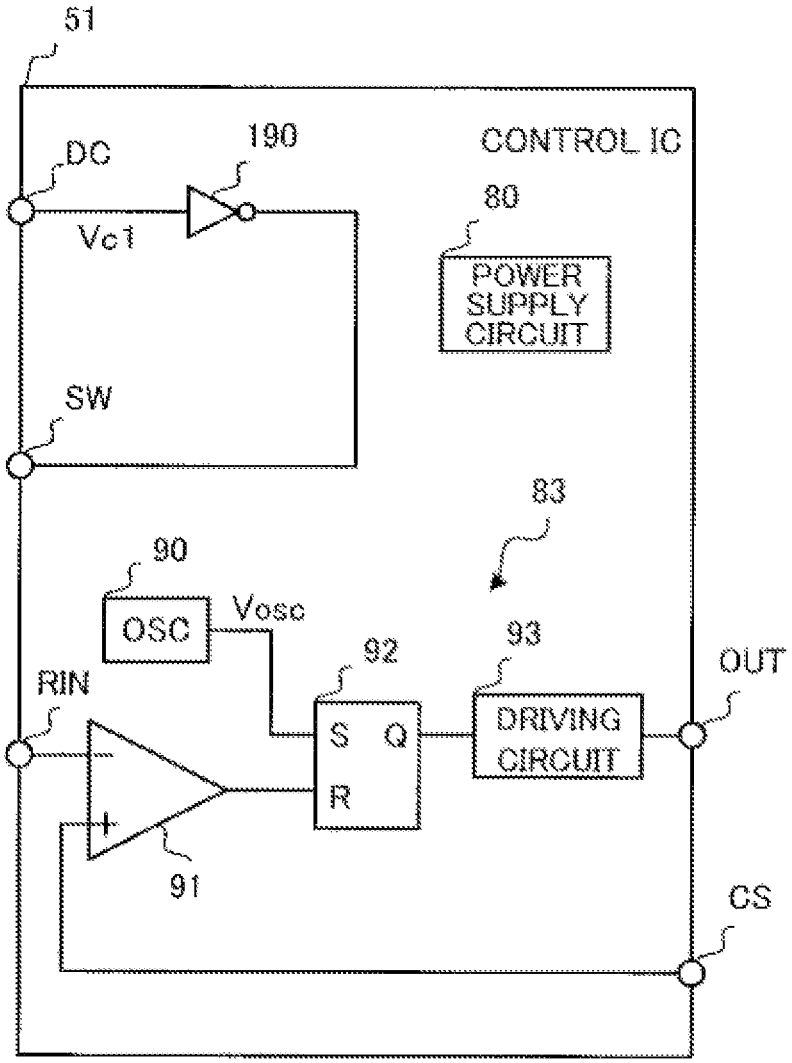
FIG. 6 is a diagram illustrating an example of a configuration of a control IC 51.

FIG. 6 is a diagram illustrating another embodiment of the control IC. When comparing control IC 51 with the control IC 50 illustrated in FIG. 1, the two are similar except that an inverter 190 is provided in place of reference voltage circuit 81 and comparator 82. Note that, similar blocks are designated with similar reference numerals in FIGS. 1 and 6.

The inverter 190 (charging/discharging circuit) outputs a signal at L level to the terminal SW when the level of voltage Vc1 applied to the terminal DC is higher than the predetermined level VA and outputs a signal at H level to the terminal SW when the level of voltage Vc1 is lower than the predetermined level VA. As described above, even when using an inverter 190 with the predetermined level VA as the threshold value, the capacitor 67 can be charged/discharged similar to the above-described comparator 82. Therefore, even when control IC 51 is used instead of control IC 50 for the LED driving circuit 10, the variation in the driving current Is, for example, can be suppressed similar to the case where the control IC 50 is used.

Another Embodiment of the Oscillation Circuit

Figure 7:
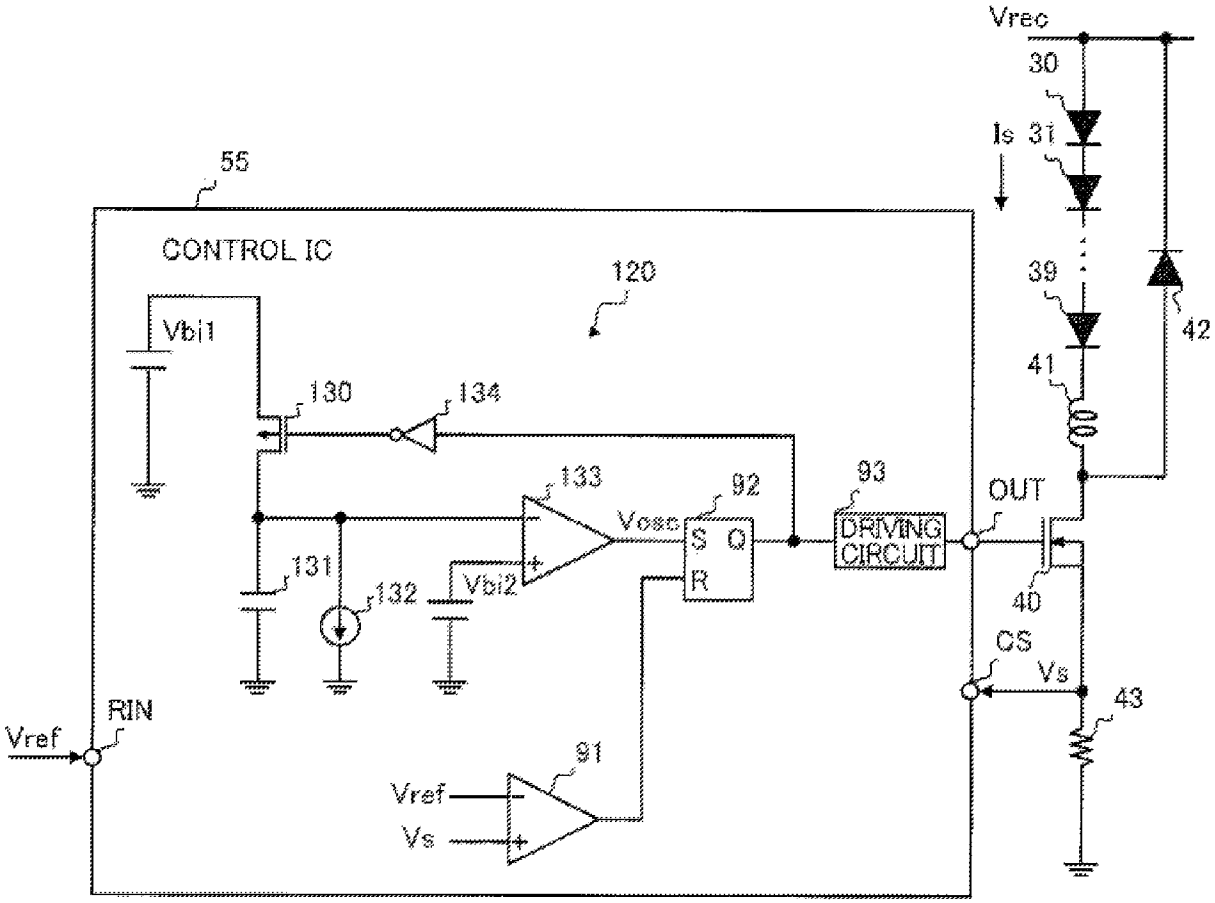
FIG. 7 is a diagram illustrating a configuration of an oscillation circuit 120.
Figure 8:
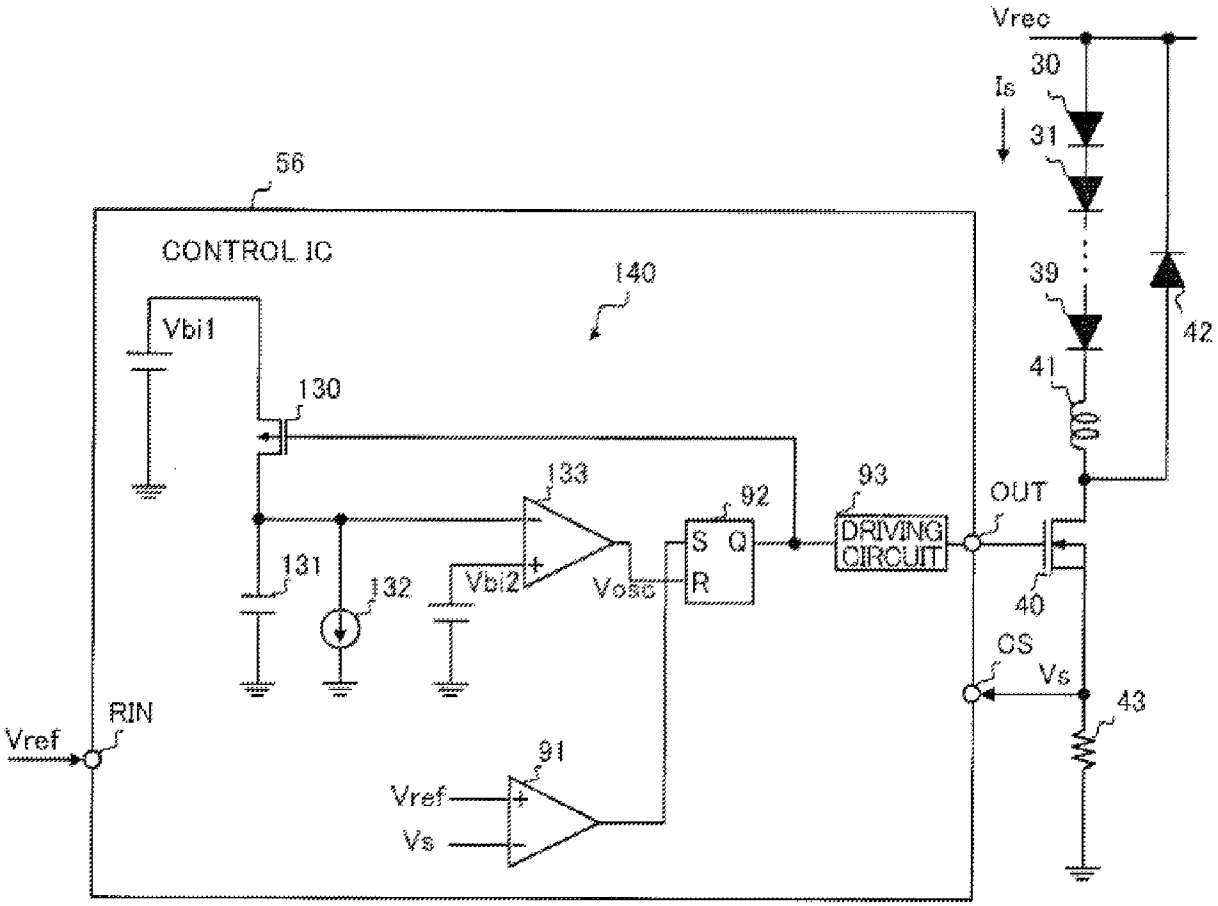
FIG. 8 is a diagram illustrating a configuration of an oscillation circuit 140.
Figure 9:
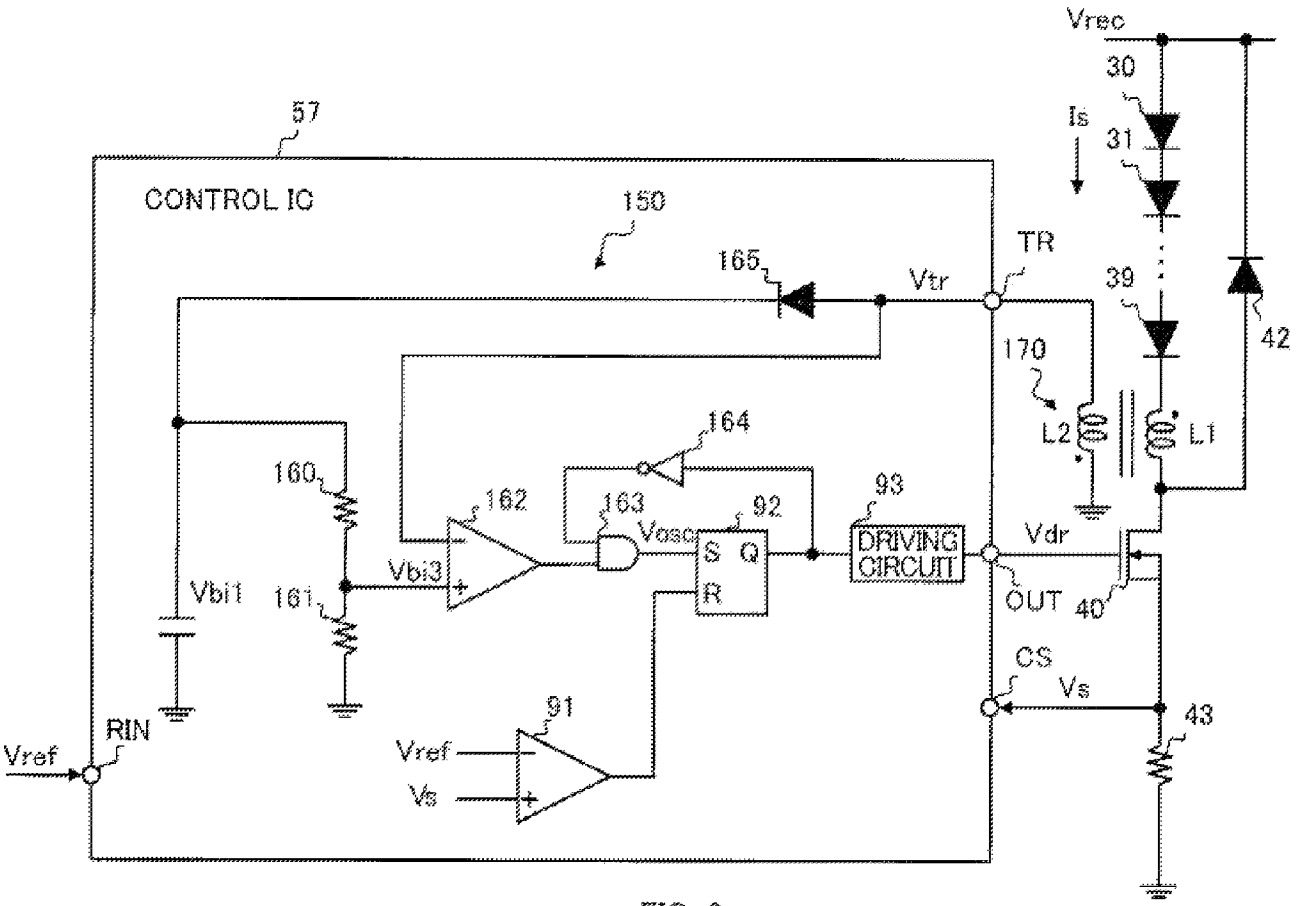
FIG. 9 is a diagram illustrating a configuration of an oscillation circuit 150.

Here, another embodiment of the oscillation circuit will be described with reference to FIGS. 7 to 9. In FIGS. 7 to 9, blocks similar to those in FIG. 1 are designated with same reference numerals. Moreover, blocks such as the reference voltage generation circuit 22, the comparator 82 and the like are omitted as appropriate in FIGS. 7 to 9.

<<Oscillation Circuit 120>>

FIG. 7 is a diagram illustrating an example of an oscillation circuit 120 which controls to maintain constant the OFF time of the NMOS transistor 40. The oscillation circuit 120 is provided in a control IC 55 and is configured to include a PMOS transistor 130, a capacitor 131, a bias current source 132, a comparator 133, an inverter 134, and an SR flip-flop 92.

When the oscillation signal Vosc of the comparator 133 becomes H level, for example, the Q output of the SR flip-flop 92 also becomes H level and the NMOS transistor 40 is turned on. At this time, since the PMOS transistor 130 is turned on, the level of the charging voltage of the capacitor 131 becomes the level of a bias voltage Vbi1. Then, when current Is increases and the voltage Vs becomes the reference voltage Vref, the SR flip-flop 92 is reset, and the Q output becomes H level. At this time, since the PMOS transistor 130 is turned off, the capacitor 131 is discharged by a current (constant current) of the bias current source 132. And when the charging voltage of the capacitor 131 becomes lower than the bias voltage Vbi2, the comparator 133 changes the oscillation signal Vosc to H level again. Note that, time since the discharge of the capacitor 131 is started until when the level of the charging voltage becomes the level of the voltage Vbi2, that is, time since the NMOS transistor 40 is turned off until the NMOS transistor 40 is turned on is constant. Therefore, the OFF time of the NMOS transistor 40 is controlled to remain constant. On the other hand, the time while the NMOS transistor 40 is turned on varies in accordance with the level of the reference voltage Vref, for example. However, the time while the NMOS transistor 40 is turned on is determined in advance in accordance with the level of the reference voltage Vref. Thus, the driving circuit 93 switches the NMOS transistor 40 at intervals determined in advance, that is, at predetermined intervals in accordance with the level of the reference voltage Vref.

<<Oscillation Circuit 140>>

FIG. 8 is a diagram illustrating an example of an oscillation circuit 140 which controls to maintain constant the ON time of the NMOS transistor 40. The oscillation circuit 140 is provided in a control IC 56 and is configured to include a PMOS transistor 130, a capacitor 131, a bias current source 132, a comparator 133, and a SR flip-flop 92. Here, voltage Vs is applied to the inverting input terminal of the comparator 91, and reference voltage Vref is applied to the non-inverting input terminal of the comparator 91.

In the oscillation circuit 140, the oscillation signal Vosc from the comparator 133 is inputted to the R input reset) of the SR flip-flop 92, and an output of the comparator 91 is inputted to the S input of the SR flip-flop 92. And the Q output of the SR flip-flop 92 is applied to the gate of the PMOS transistor 130.

First, when the NMOS transistor 40 is turned off, the current Is drops. When the voltage Vs drops to the reference voltage Vref, the Q output of the SR flip-flop 92 becomes H level to turn on the NMOS transistor 40. Moreover, when the Q output of the SR flip-flop 92 becomes H level, the PROS transistor 130 is turned off, and thus, the discharge of the capacitor 131 is started. When the level of the charging voltage of the capacitor 131 becomes the level of the bias voltage Vbi2, the SR flip-flop 92 is reset so to turn off the NMOS transistor 40.

The time since the discharge of the capacitor 131 had been started until the level of the charging voltage becomes the level of the voltage Vbi2, that is, time from the NMOS transistor 40 is turned on until the NMOS transistor 40 is turned off remains constant. Therefore, the ON time of the NMOS transistor 40 is controlled to remain constant. On the other hand, the time during which the NMOS transistor 40 is turned off changes, for example, in accordance with the level of the reference voltage Vref. However, the time during which the NMOS transistor 40 is turned off is predetermined in accordance with the level of the reference voltage Vref. Thus, the driving circuit 93 switches the NMOS transistor 40 at intervals determined in advance in accordance with the level of the reference voltage Vref, that is, at predetermined intervals.

<<Oscillation Circuit 150>>

FIG. 9 is a diagram illustrating an example of a so-called pseudo-resonance oscillation circuit 150. The oscillation circuit 150 is provided in a control IC 57 and is configured to include resistors 160 and 161, a comparator 162, an AND circuit 163, an inverter 164, and a diode 165. And a transformer 170 is provided outside the control IC 57. The transformer 170 includes a primary coil L1 and a secondary coil L2, and the primary coil L1 is insulated from the secondary coil L2. The primary coil L1 is provided in place of the inductor 41 in FIG. 1, and the primary coil L1 and the secondary coil L2 are electromagnetically coupled with each other's polarities reversed (negative coupling).

Figure 10:
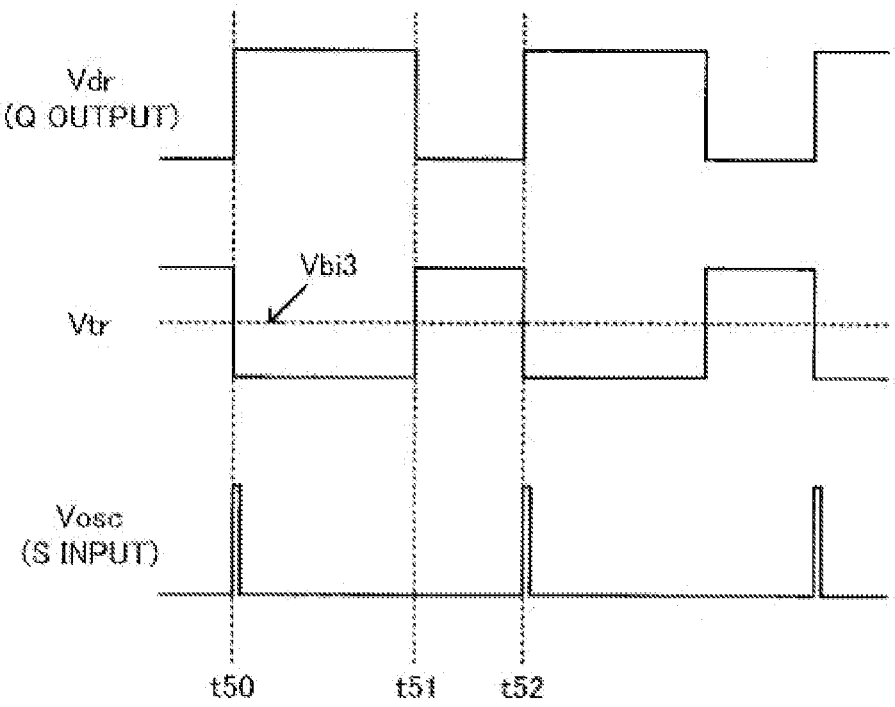
FIG. 10 is a diagram for explaining an operation of the oscillation circuit 150.
Figure 11:
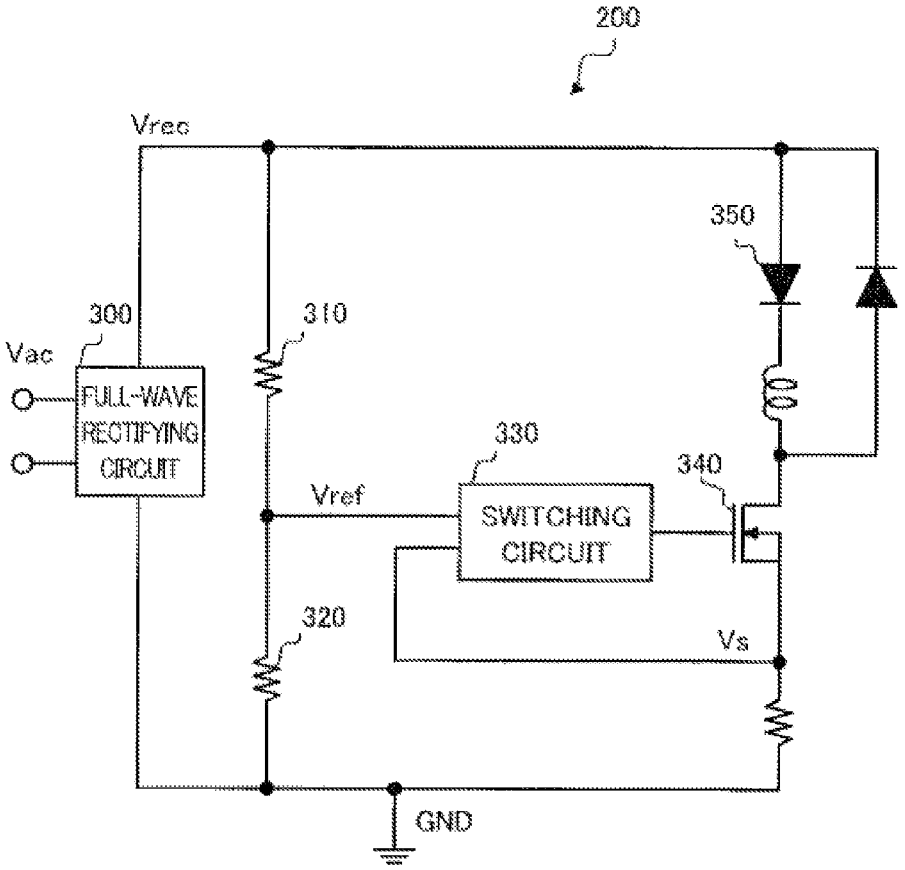
FIG. 11 is a diagram illustrating a configuration of a common LED driving circuit 200.

Here, an operation of the oscillation circuit 150 in FIG. 9 will be described with reference to the timing chart in FIG. 10. First, the NMOS transistor 40 is turned on when a driving signal Vdr outputted from the driving circuit 93 becomes H level at time t50. Thereafter, the SR flip-flop 92 is reset when the voltage Vs increases in accordance with an increase in current Is and becomes higher than the reference voltage Vref at time t51. As a result, the NMOS transistor 40 is turned off. Moreover, voltage Vtr of terminal TR to which the secondary coil L2 is connected increases and exceeds voltage Vbi3 when the NMOS transistor 40 is turned off since the primary coil L1 and the secondary coil L2 are electromagnetically coupled with each other's polarities reversed. Thereafter, the output of the comparator 162 and the oscillation signal Vosc which is an output of the AND circuit 163 become H level when energy accumulated in the secondary coil L2 is emitted to lower voltage Vtr below voltage Vbi3 at time t52. Thus, the NMOS transistor 40 is turned on again at time t52. As described above, the oscillation circuit 150 turns on the NMOS transistor 40 at predetermined intervals determined between time t50 and time t52.

The LED driving circuit 10 of the present embodiment has been described above. When the amplitude of the rectified voltage Vrec is smaller than the predetermined amplitude Vp in the LED driving circuit 10, the voltage obtained by dividing the value of the rectified voltage Vrec by the voltage-dividing ratio B with a large value becomes the reference voltage Vref. Moreover, when the amplitude of the rectified voltage Vrec is larger than the predetermined amplitude Vp, the voltage obtained by dividing the value of the rectified voltage Vrec by the voltage-dividing ratio A with a small value becomes the reference voltage Vref. Therefore, variation in the current value of the driving current Is of each of the LEDs 30 to 39 can be suppressed since the level of the reference voltage Vref does not vary largely even when the amplitude of the AC voltage Vac largely fluctuates.

Moreover, in the LED driving circuit 10, it is not until time period TB longer than time period TA has elapsed since start that the NMOS transistor 66 is turned on. That is, reference voltage Vref1 obtained by dividing the rectified voltage Vrec by the voltage-dividing ratio A is constantly outputted regardless of the amplitude of the AC voltage Vac at start. Therefore, a large current would not flow through the LEDs 30 to 39 realizing a so-called soft start function in the LED driving circuit 10.

The capacitor 67 can be reliably discharged when the level of the voltage Vc1 becomes the predetermined level VA by using the comparator 82.

Moreover, for example, the number of elements can be reduced when configuring the capacitor 67 to charge/discharge using the inverter 190.

The level of the reference voltage Vref having a shape similar to the rectified voltage Vrec can be varied with a simple configuration by adjusting the voltage-dividing ratio of the voltage-dividing circuit 65 to which the rectified voltage Vrec is applied.

In the LED driving circuit 10, a non-insulating type circuit configuration was formed with the LEDs 30 to 39 connected to the inductor 41, however, the configuration is not limited to such. An effect similar to the present embodiment can be achieved, for example, when a circuit (an insulated-type circuit) in which energy generated when switching the NMOS transistor 40 is supplied to the LED through the transducer (not shown).

A transmission gate or the like may be used instead of the NMOS transistor 66, for example.

When the amplitude of the AC voltage Vac fluctuates within the range of, for example, 90 to 140 V the predetermined level VA may be set at a level higher than the level of the voltage Vc1 when the amplitude of the rectified voltage Vrec becomes 140V. In such a case, a soft start is reliably realized similar to the case illustrated in FIG. 5.

The switching control circuit 83 switches the NMOS transistor 40 on the basis of an oscillation signal Vosc of the oscillation circuit 90 and the like, for example.

The above embodiments of the present invention are simply for facilitating the understanding of the present invention and are not in any way to be construed as limiting the present invention. The present invention may variously be changed or altered without departing from its spirit and encompass equivalents thereof.

Although a full-wave rectifying circuit is used in an embodiment of the present invention, a half-wave rectifying circuit may also be used.

What is claimed is:

1. A light emitting element driving circuit comprising:

a rectifying circuit configured to output a rectified voltage obtained by providing rectification to an AC voltage;

a voltage-dividing circuit configured to output as a reference voltage, a divided voltage obtained by dividing the rectified voltage, the voltage dividing circuit including a first resistor coupled between the rectified voltage and a source of operating potential;

a transistor configured to increase a driving current of a light emitting element in accordance with the rectified voltage when turned on and to reduce the driving current of the light emitting element when turned off;

a control circuit configured to bring the transistor to an on state or an off state at predetermined intervals and to bring the transistor to the other of the on state or the off state when a voltage according to a current flowing through the transistor increases and becomes the reference voltage; and a voltage-dividing ratio adjustment circuit configured to set a voltage-dividing ratio of the voltage dividing circuit as a first voltage-dividing ratio to reduce the reference voltage when an amplitude of the rectified voltage is larger than a predetermined amplitude and to set the voltage-dividing ratio as a second voltage-dividing ratio to increase the reference voltage when an amplitude of the rectified voltage is smaller than the predetermined amplitude, the voltage dividing ratio adjustment circuit comprising a switch having a control terminal and first and second current carrying terminals, wherein the first resistor has a terminal connected to the first current carrying terminal a of the switch and a second terminal connected to the second current carrying terminal of the switch.

2. The light emitting element driving circuit according to claim 1, wherein the voltage-dividing ratio adjustment circuit includes:

a smoothing circuit configured to output a DC voltage obtained by smoothing a voltage according to the rectified voltage;

a charging/discharging circuit configured to charge a capacitor when a level of the DC voltage is lower than a first level indicating a level of the voltage obtained when the voltage according to the rectified voltage with the predetermined amplitude is smoothed in the smoothing circuit, and to discharge the capacitor when the level of the DC voltage is higher than the first level; and the switch configured to set the voltage-dividing ratio to the second voltage-dividing ratio when the level of a charging voltage of the capacitor is higher than a second level and to set the voltage-dividing ratio to the first voltage-dividing ratio when the level of the charging voltage is lower than the second level, wherein the charging/discharging circuit charges the capacitor such that the level of the charging voltage becomes the second level during a second period longer than a first period, the first period being a period from when the rectified voltage with the predetermined amplitude is smoothed by the smoothing circuit until when a level of the DC voltage becomes the first level.

3. The light emitting element driving circuit according to claim 2, wherein the charging/discharging circuit includes:

a voltage generation circuit configured to generate a voltage of the first level; and a comparison circuit configured to charge/discharge the capacitor based on the DC voltage applied to an inverting input terminal and the voltage at the first level generated in the voltage generation circuit and applied to a non-inverting input terminal.

4. The light emitting element driving circuit according to claim 2, wherein the charging/discharging circuit includes an inverter circuit configured to charge the capacitor when a level of the DC voltage is lower than the first level and discharge the capacitor when a level of the DC voltage is higher than the first level.

5. The light emitting element driving circuit according to claim 2, wherein the voltage-dividing circuit includes a first resistor to which the rectified voltage is applied, a second resistor connected in series with the first resistor, and a third resistor connected in series with the second resistor and to which a grounding voltage is applied, the reference voltage being a voltage of a node to which the second and third resistors are connected, and the switch being connected in parallel with the second resistor.

6. The light emitting element driving circuit according to claim 3, wherein the voltage-dividing circuit includes a first resistor to which the rectified voltage is applied, a second resistor connected in series with the first resistor, and a third resistor connected in series with the second resistor and to which a grounding voltage is applied, the reference voltage being a voltage of a node to which the second and third resistors are connected, and the switch being connected in parallel with the second resistor.

7. The light emitting element driving circuit according to claim 4, wherein the voltage-dividing circuit includes a second resistor to which the rectified voltage is applied, the second resistor connected in series with the first resistor, and a third resistor connected in series with the second resistor and to which a grounding voltage is applied, the reference voltage being a voltage of a node to which the first and third resistors are connected, and the switch being connected in parallel with the first resistor.

8. A method for driving a light emitting element, comprising:

generating a DC voltage in response to an amplitude of a rectified voltage by voltage dividing the rectified voltage to generate a divided voltage and smoothing the divided voltage to generate a smoothed divided voltage;

generating a reference voltage in response to the DC voltage, by comparing the smoothed divided voltage with a first voltage of a predetermined level to generate a second comparison signal, wherein the predetermined level is equal to the level of the DC voltage generated in response to the amplitude of the rectified voltage input into a smoothing circuit being at a predetermined amplitude; and charging a capacitor using the second comparison voltage in response to the smoothed divided voltage being less than the predetermined level of the amplitude of the rectified voltage or discharging the capacitor using the second comparison voltage in response to the smoothed divided voltage being greater than the predetermined level of the amplitude of the rectified voltage;

generating a first comparison signal at a first node in response to comparing the reference voltage with a sense voltage;

generating a drive signal at a second node in response to the first comparison signal; and using the drive signal to generate a drive current that flows through at least one light emitting element.

9. The method of claim 8, wherein generating the reference voltage further includes generating another divided voltage, wherein a factor in generating the another divided voltage is a parallel combination of a drain-to-source resistance of a first transistor and resistor coupled across a drain terminal and a source terminal of the first transistor.

10. The method of claim 9, wherein the drain-to-source resistance of the first transistor is at a first level in response to the first transistor being in an off state and at a second level in response to the first transistor being in an on state.

11. The method of claim 10, wherein the drain-to-source resistance of the first transistor in the off state is larger than a resistance of the resistor and the drain-to-source resistance of the first transistor in the on state is less than a resistance of the resistor.

12. The method of claim 11, wherein a resistance value of the parallel combination the drain-to-source resistance of the first transistor and the resistor is substantially equal to the value of the resistor in response to the first transistor being in the off state and wherein the resistance value of the parallel combination of the drain-to-source resistance of the first transistor and the resistor is substantially zero in response to the first transistor being in the on state.

13. The method of claim 12, wherein using the drive signal to generate a drive current that flows through at least one light emitting element includes turning on a second transistor that is coupled for receiving the drive signal; and enabling the at least one light emitting diode to emit light in response to the rectified voltage being greater than a sum of the forward voltage of the at least one light emitting element.

14. A method for driving a light emitting element, comprising:

generating a first voltage in response to a rectified voltage by voltage dividing the rectified voltage and smoothing the rectified voltage that has been voltage divided;

generating a first comparison voltage in response to comparing the first voltage with a second voltage, the second voltage at a predetermined level;

using the first comparison voltage and a capacitor to generate a first reference voltage by charging the capacitor using the first comparison voltage in response to the smoothed rectified voltage that has been voltage divided being less than a predetermined level of an amplitude of the rectified voltage or discharging the capacitor using the first comparison voltage in response to the smoothed rectified voltage that has been voltage divided being greater than the predetermined level of the amplitude of the rectified voltage;

comparing to the first reference voltage with a sensed voltage to generate a second comparison voltage;

using the second comparison signal and an oscillation signal to generate an output signal that is at a first logic level at predetermined intervals in response to the oscillation signal being at the first logic level and at a second logic level in response to a detected voltage; and generating a light emitting element drive signal in response to the second comparison voltage.

15. The method of claim 14, wherein using the first comparison voltage to generate the first reference voltage includes using the first comparison voltage to control a state of a transistor to be in an on state or an off state.

16. The method of claim 15, wherein using the first comparison voltage to generate the first reference voltage includes developing the first reference voltage as a voltage divider voltage using a plurality of resistors, wherein at least one of the resistors is coupled in parallel with a drain-to-source resistance of the transistor.

17. The method of claim 16, wherein a resistance value of a parallel combination the drain-to-source resistance of the first transistor and the at least one of the resistors is substantially equal to the value of the at least one of the resistors in response to the first transistor being in the off state and wherein the resistance value of the parallel combination of the drain-to-source resistance of the first transistor and the at least one of the resistors is substantially zero in response to the first transistor being in the on state.

18. The method of claim 17, further including causing the light emitting element to emit light in response to the rectified voltage being greater than a forward voltage of the light emitting element.

* * * * *